US010539383B1

(12) United States Patent
Tal et al.

(10) Patent No.: US 10,539,383 B1
(45) Date of Patent: Jan. 21, 2020

(54) UNLOADER FOR FIREARM MAGAZINES

(71) Applicants: Ran Tal, Tel Aviv (IL); Guy Tal, Rosh Ha'Ayin (IL)

(72) Inventors: Ran Tal, Tel Aviv (IL); Guy Tal, Rosh Ha'Ayin (IL)

(73) Assignee: MAGLULA, LTD., Rosh Ha'ayin (IL)

( * ) Notice: Subject to any disclaimer, the term of this patent is extended or adjusted under 35 U.S.C. 154(b) by 0 days.

(21) Appl. No.: 16/186,510

(22) Filed: Nov. 10, 2018

Related U.S. Application Data

(60) Provisional application No. 62/618,328, filed on Jan. 17, 2018.

(51) Int. Cl.
*F41A 9/83* (2006.01)
*F41A 9/82* (2006.01)

(52) U.S. Cl.
CPC ..... *F41A 9/83* (2013.01)

(58) Field of Classification Search
CPC ..... F41A 9/82
See application file for complete search history.

(56) References Cited

U.S. PATENT DOCUMENTS 3,153,296 A * 10/1964 Hofstetter ..... F41A 9/60 42/87
3,939,590 A 2/1976 Musgrave
4,127,954 A * 12/1978 Hausmann ..... F41A 9/68 42/50
4,447,976 A * 5/1984 Cooper ..... F41A 9/63 42/18
5,417,003 A 5/1995 Claveau
6,810,616 B2 11/2004 Tal
7,805,874 B2 10/2010 Tal
8,065,830 B2 11/2011 Twardy
2003/0226306 A1* 12/2003 Hines ..... F41A 9/83 42/90
2010/0251590 A1* 10/2010 Fitzpatrick ..... F41A 9/65 42/50

(Continued)

FOREIGN PATENT DOCUMENTS

CN 2017-406545 * 5/2017

OTHER PUBLICATIONS magpump.com, https://magpump.com/products/magazine-unloaders/magdump-ar-15-magazine-unloader, date of publication on Internet unknown.

(Continued)

*Primary Examiner* — Bret Hayes
(74) *Attorney, Agent, or Firm* — David Pressman

(57) ABSTRACT

An unloader (10) for firearm magazines (40) has a plate hingedly coupled to a back of the magazine so the plate can be moved against or tilted away from the magazine. The plate has a projecting plunger at its top that can push a round out of the top of the magazine when the plate is moved against the magazine's back. The plate is hingedly coupled to the magazine by holding it with a thumb or finger or by hinging it to an adapter that is coupled to the magazine. A user holds the adapter or the plate against the magazine and moves the plate between open and closed positions. In the closed position the plunger forces the top round forward and out from the lips of the magazine and in the open position the plunger allows the magazine's follower to push a second round into the top position.

17 Claims, 4 Drawing Sheets

(56) References Cited

U.S. PATENT DOCUMENTS

| | | | | |
|---|---|---|---|---|
| 2011/0113668 | A1* | 5/2011 | Pestana | F41A 9/63<br>42/90 |
| 2013/0232843 | A1* | 9/2013 | Bajuelo | F41A 9/83<br>42/87 |
| 2014/0298704 | A1* | 10/2014 | Niccum | F41A 9/83<br>42/87 |
| 2015/0377573 | A1 | 12/2015 | Niccum | |
| 2018/0080728 | A1* | 3/2018 | Couie | F41A 9/83 |

OTHER PUBLICATIONS

Heckler & Koch, https://www.hkparts.net/shop/pc/Magazine-Unloader-For-HK-91-G3-PTR-German-42p1508.htm, date of publication on Internet unknown.

* cited by examiner

UNLOADER FOR FIREARM MAGAZINES

CROSS-REFERENCE TO COPENDING APPLICATION

This application claims priority of Provisional Patent Application Ser. No. 62/618,328, Filed 2018 Jan. 7.

BACKGROUND

Prior Art

Small firearms (pistols, assault rifles, submachine guns, etc.) utilize and fire rounds (also known as cartridges and ammunition). Each round is substantially elongated and comprises a deep cuplike case (also known as a shell casing and sometimes also a cartridge) and a bullet, slug, or head coupled to the case. The case, usually of brass, has a closed or rear end and an open or front end, and is partially filled with an explosive propellant. The rear end of the case has a rim or flange and contains a primer that will explode and ignite the propellant when struck by the hammer of the firearm. The bullet, usually of lead (optionally jacketed) is partially inserted into the front end of the case and the case is crimped onto the bullet to hold it in place.

A magazine or clip usually holds the rounds and feeds them into the firearm. Detachable magazines have become dominant throughout the world. The term 'magazine' is broad, encompassing several geometric variations, including box, curved, and drum magazines. Most detachable boxed and curved magazines are similar, varying in form and structure, rather than in their general principles of operation. Drum magazine store rounds differently than boxed and curved magazines, yet they all have upper, open tops.

Magazines usually take the form of an elongated container having a generally rectangular cross-section, which is removably attached to the underside of the firearm. Magazines are commonly made of aluminum alloys, plastic, steel, or a combination. They are usually closed on five sides and open on a sixth, upwardly facing, top, side, or end, and are substantially hollow. The top or open side has a rectangular end and includes two round-retaining members, known as feed lips. Most box magazines have an internal spring which urges a follower or pusher (blank shaped piece of plastic or metal) straight toward the open side. The follower in turn urges the rounds as a group up against the lips. Some magazines, like the popular .22LR (Long Rifle) magazines made by Sturm Ruger and Co. (Ruger), of Southport, Conn., and sold under Ruger's trademark 10/22, have an internal rotatable drum which holds rounds in 1, 5, or 10 elongated indents or grooves in the drum. The drum feeds each round toward the lips by internal coiled spring pressure. When a top-most round is ejected or unloaded from the magazine the internal drum also acts as follower and feeds a new round between the lips. The lips of magazines act as a stop for the rounds so that they are not expelled from the magazine.

Rounds are stacked or oriented in the magazine such that the longitudinal axes of the rounds are substantially parallel with the barrel of the firearm. Adjoining rounds are oriented side-by-side, i.e., the bullets of adjacent rounds are next to each other, as are the cases.

The rounds are usually stacked in the magazine, either in a single straight column (also called single-stacked) or in a staggered, zigzag, column fashion (also called double-stacked or high-capacity magazines), or arranged in a circle in drum magazines.

Commonly, in pistol magazines and in some submachine gun magazines, whether staggered or not, the space between the retaining lips is smaller than the case diameter of the rounds so that the two lips of the magazine hold the topmost round. Magazines of most assault rifles and submachine guns contain staggered rounds, and in contrast to the above pistol magazines, the topmost round is held in place by only a single lip.

Prior to use, a firearm magazine must be loaded (charged or filled). When a magazine is being loaded, it is necessary to depress any previously loaded rounds and the follower to provide space below the lips so that each additional round can be inserted. Each time another round is loaded the spring is further stressed, presenting an accumulating burden on the fingers of the user who manually loads the rounds.

Often it is necessary to unload or expel rounds from a loaded magazine for cleaning, safety, service, or storage. Unloading rounds can be done with one's bare hands, yet pain intensifies as more rounds are unloaded one-by-one against the spring's force on the rounds toward the lips. Rounds may be unloaded from a magazine by either pushing or forcing the top round forward from its rim or flange side so that it moves parallel the lips, or by releasing spring pressure from the topmost round, thereby removing the force pressing the topmost round to the lips so that it can be slid forward from the lips and out of the magazine.

To increase unloading speed and decrease finger pain, several tools have been developed to unload magazines. These are divided between:

A. 'non-gravitational' unloaders which have a substantially top or above-magazine mechanism to force the topmost round forward and out, pushing the round from the rear or rim and sliding it, under spring friction, clear of the lips; these unloaders use a protrusion to engage the rear of the round, and B. 'gravitational' unloaders which force the second round, and hence all other rounds below it, into the magazine away from the lips, thus releasing pressure on the top round, allowing it to gravitationally slide below the lips and out of the magazine when the magazine is angled downwards.

Some prior-art unloaders are shown in the following tables:

Utility Patents and Applications

| Patent No. | Issue or Pub. Date | Patentee or Applicant | Unloader type | Relative disadvantage |
|---|---|---|---|---|
| US8,065,830 | Nov. 29, 2011 | Twardy; Chris | A | Operationally unstable and inefficient unloader which is uncomfortable and hence slow in operation. |
| US7,805,874 | Oct. 5, 2010 | Tal; Guy, Tal; Ran | A | Unloader function is simple and relatively slow. |

-continued

| Utility Patents and Applications | | | | |
|---|---|---|---|---|
| Patent No. | Issue or Pub. Date | Patentee or Applicant | Unloader type | Relative disadvantage |
| US6,810,616 | Nov. 2, 2004 | Tal; Guy, Tal; Ran | A & B | Different concept of unloading mags. |
| US5,417,003 | May 23, 1995 | Claveau; Gerard A. | A & B | Operationally unstable and inefficient unloader which is uncomfortable and hence slow in operation. |
| US3,939,590 | Feb. 24, 1976 | Musgrave; Daniel D. | B | Operationally unstable and inefficient unloader which is uncomfortable and hence slow in operation. |
| Application: US20030226306 | Dec. 11, 2003 | Hines, Stephen C. | A & B | Operationally unstable and inefficient unloader which is uncomfortable and hence slow in operation. |
| Application: U520150377573 | Dec. 31, 2015 | Niccum; Jeffery N. | | Bulky construction with more parts and slower operation. |
| CN205561638 | Sep. 7, 2016 | He Jiaqi, He Longfei | B | Bulky construction with more parts and slower operation. |
| CN206208099 | May 31, 2017 | Fu Xinzhou | B | Bulky construction with more parts and slower operation. |

| Publications | | | |
|---|---|---|---|
| Publication | Manufacturer | | Relative disadvantage |
| https://magpump.com/products/magazine-unloaders/magdump-ar-15-magazine-unloader | Magpump.com | A | Extremely bulky construction with linear-moving plunger. |
| https://www.hkparts.net/shop/pc/Magazine-Unloader-For-HK-91-G3-PTR-German-42p1508.htm | Heckler & Koch, Germany | B | Very bulky construction with side-to-side rotating plunger. |

Alternatively, users often use simple, but awkward and difficult-to-use elongated objects to push out rounds below the lips (type A above) or push down the second round to drop the topmost round out (type B). These objects can be an edge of a screwdriver, knife, a loose round, or unloading protrusions added to magazine loader tools or edges thereof.

Advantages

Accordingly, several advantages of one or more aspects of our unloader design are to provide:

(a) an unloader mechanism and method which can be adapted to unload a wide range of magazines,
(b) an unloader which can be used more efficiently and comfortably than other unloaders,
(c) an unloader which is workable at relatively high speed with minimal fatigue to user's fingers,
(d) an unloader which is durable and simple to operate in tough, varying conditions, and
(e) a low-cost unloader which is pocket-sized, lightweight, and has few parts.

Further advantages of one or more aspects will become apparent from a consideration of the drawings and ensuing description.

SUMMARY

A tool and method for facilitating unloading of rounds out of a firearm magazine comprises, in one aspect, two parts: a magazine adapter and a pusher hinged to or pivotable on the adapter at the lower end of each. They are constructed to angle between an orientation parallel to or at an acute open angle to the back wall of the magazine. The pusher has a projecting plunger that is distal from the pivot, is generally perpendicular to the pusher, and has a distal tip. The adapter is shaped to fit on the top rear-side of a specified set of magazines, for example: the 1911 .45 cal single-stack magazines or the Ruger 10/22 .22LR magazines. When the unloader is fitted to the magazine and the pusher is angled away from the magazine, the plunger is withdrawn from between the lips of the magazine and the topmost round. When the pusher is pivoted parallel to the magazine it pushes the rear-side or rim of the topmost round underneath the lips forward and out of the magazine. The user holds the magazine and the adapter firmly in place with one hand while angling the pusher back and forth quickly with the other hand, thus pushing and expelling the rounds forward one-by-one with the tip of the plunger. The unloader can be removed from the magazine and is of a non-gravitational type.

DRAWINGS

REFERENCE NUMERALS

| | |
|---|---|
| 10 unloader | 12 adapter |
| 14 adapter sidewalls | 16 hinge projection |
| 18 aligner hole | 18P magazine catch pin |
| 19 magazine recess | 20 pusher |
| 22 plunger | 24 pusher sidewalls |
| 26 hinge through hole | 28 stopper |
| 30 grabber | 40 firearm magazine |
| 42 lips of magazine | 44 round(s) of ammunition |
| 50 first alternative loader | 52 adapter body |
| 54 adapter sidewalls | 56 inclined sidewalls |
| 60 first alternative pusher part | 62 pusher sidewall |
| 64 plunger | 70 pistol magazine |
| 72 lips of pistol magazine | 74 pistol round |
| 80 second alternative loader | 82 adapter body |
| 84 inclined sidewalls | 86 second alternative pusher |
| 88 plunger | 90 rifle magazine |
| 92 lips of rifle magazine | 94 rifle round |
| 100 plate of third alternative unloader | 102 unloader sidewalls |
| 104 unloader plunger | 106 unloader grabber |
| 108 unloader aligning hole | |

DESCRIPTION

First Embodiment—FIGS. 1A-1D—Perspective Views

Figure 1A:
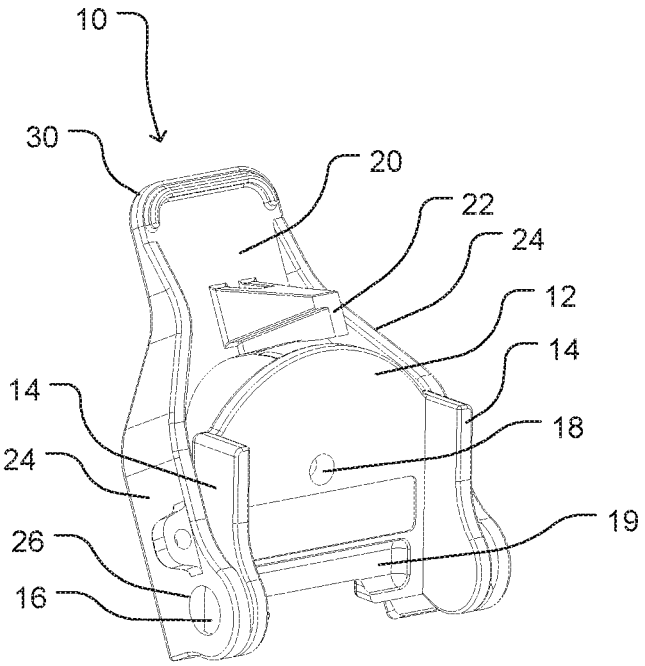
FIG. 1A is a front perspective view of our magazine unloader in an open position.

FIG. 1A is a front perspective view of a first embodiment of a magazine unloader 10, arranged to remove rounds easily from a loaded magazine. The unloader shown is adapted to fit the aforementioned Ruger .22LR 10/22 magazine 40 (FIG. 2A), which is made of polymer. These magazines all have similar upper top and lip designs, and have a magazine-aligning catch pin projecting from the upper rear wall of the magazine, not shown. Unloader 10 preferably comprises two main parts, an adapter 12 and a pusher 20. These are shown in their open-angle position in FIG. 1A and separated in FIG. 1D.

Adapter or adapter plate 12 comprises a substantially flat plate having two perpendicular side walls 14 extending out from its side edges. Each side wall 14 has a round hinge extension at its lower end with an outwardly projecting pintle or pivot pin 16 (best seen in FIG. 1D). The adapter also includes, in this embodiment, a centered aligner hole 18 for fitting snugly onto the magazine's rear catch pin 18P (partly seen in FIG. 2C). The surface of the reverse side of the adapter plate around hole 18 is used as finger rest, as also illustrated in FIG. 2C. Side walls 14 have a spacing between them to fit over the lateral sides of the magazine. (A recess 19 at the bottom of the adapter plate is included to provide clearance for a rear horizontal protrusion on the Ruger 10/25 BX magazine.)

Pusher or pusher plate 20 has a substantially flat upper part and a bifurcated bottom part comprising two legs with a space between the legs. As shown in FIG. 2C, when the pusher plate and the adapter plate are mated, a finger or thumb can be placed in the space between the two legs and against the adapter plate to hold it against the magazine. The legs have two side walls 24, one on each vertical side, extending forward and spaced to loosely fit over adapter side walls 14. These side walls are perpendicular to the flat top part of the pusher plate. Each side wall 24 has a round through hole 26 at its lower side adapted to receive and journal a respective pintle 16 of the adapter, thus forming hinge between the adapter and the pusher (FIGS. 1A and 1D show only one pintle 16). The legs of the pusher can be spread slightly during assembly so that their walls can be slid over the pintles of the adapter until pintles 16 of the adapter snap into holes 26 of the pusher, thereby attaching the pusher and adapter together by their hinge parts to form a hinged pair of leaves. The arrangement shown can be reversed, where pintles extend from the pusher plate legs and the adapter has the pintle-journaling holes.

Pusher 20 includes a stopper recess 28 (FIG. 1D) adapted to engage a portion of the bottom edge of the adapter body and to limit the maximum open angle between the two parts. In this embodiment, the maximum open angle is about 24°. This open angle is set while adapting the unloader to specific magazines. A projecting plunger 22 (FIG. 1) extends forward from the pusher's center and distal from the rotating axis of the unloader. As best shown in FIG. 1A, plunger 22 has a thicker base part for strength at the pusher side; the plunger narrows toward the tip. The pusher plate has a projecting tab or grabber 30 above the plunger which is shaped to be grasped easily.

Figure 1B:
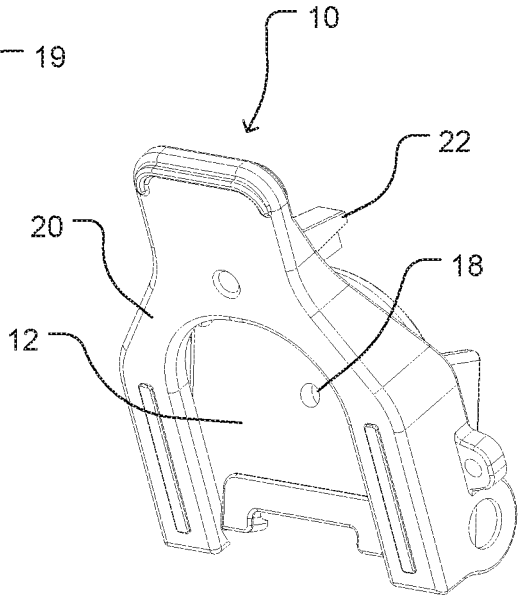
FIG. 1B is a rear perspective view of our magazine unloader in the open position.

FIG. 1B is a perspective rear view of unloader 10 in the open position where pusher 20 is angled partly away from adapter 12.

Figure 1C:
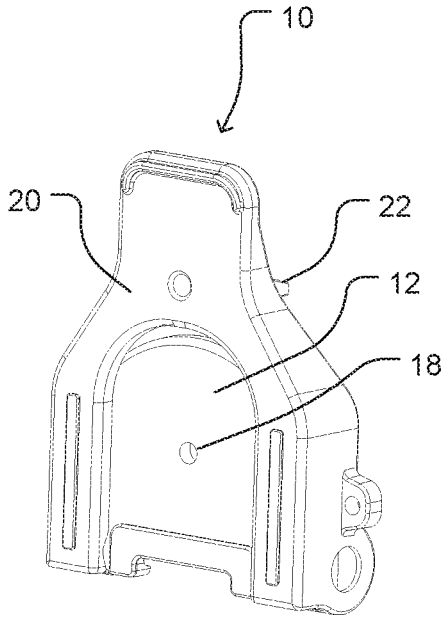
FIG. 1C is a rear perspective view of the unloader in a closed position.
Figure 1D:
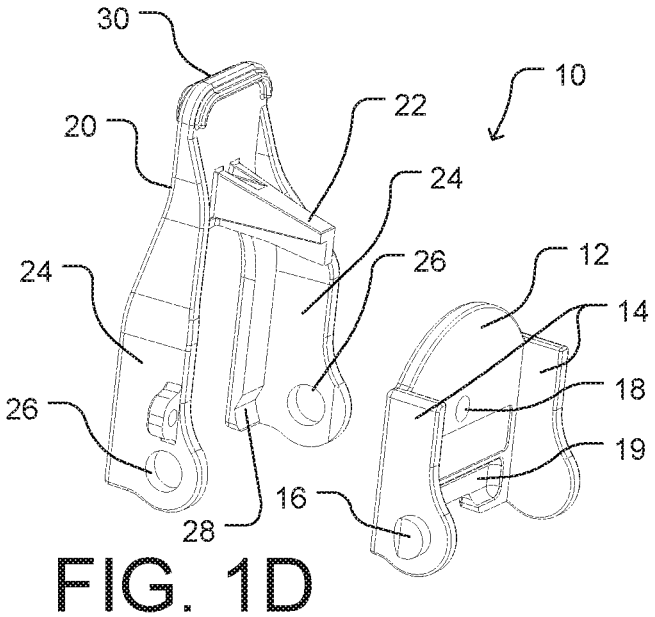
FIG. 1D is a front perspective exploded view of the unloader.

FIG. 1C is a perspective rear view of unloader 10 in a closed position where pusher 20 parallels adapter 12.

FIG. 1D is an exploded view of unloader 10 showing adapter 12 and pusher 20 in more detail.

Figure 2A:
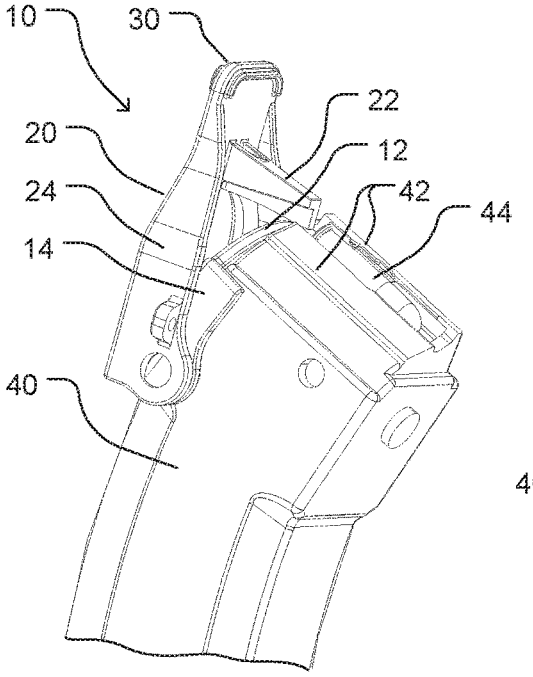
FIG. 2A is a perspective view of the unloader in an open position on a 10/22-type magazine.
Figure 2B:
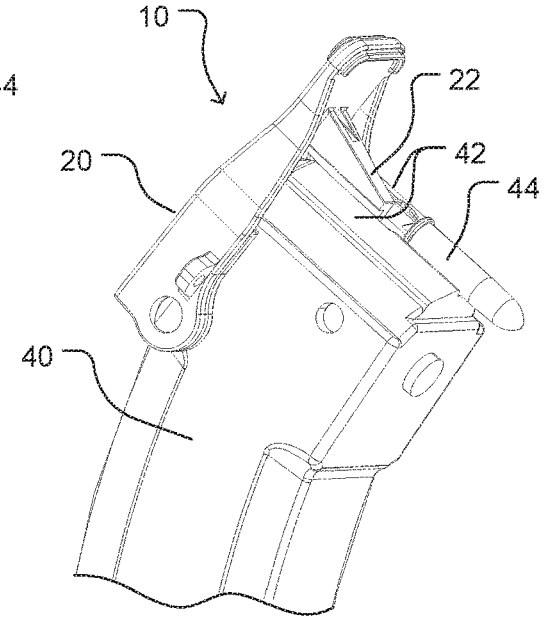
FIG. 2B is a perspective view of the unloader in a closed position on the magazine.
Figure 2C:
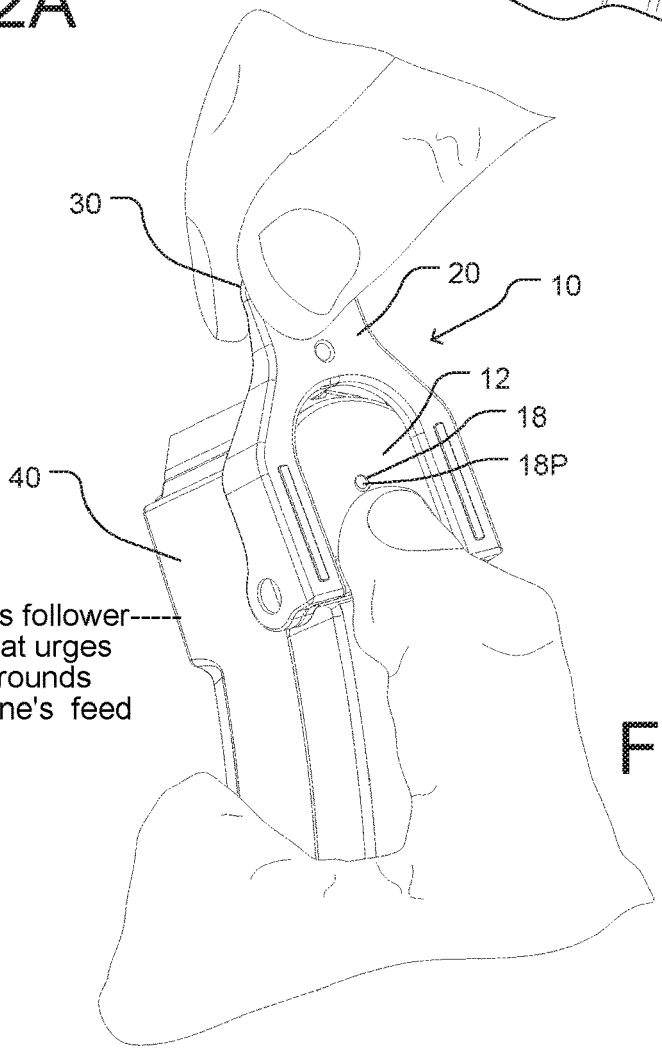
FIG. 2C is a rear perspective view of the unloader in operating position.

FIGS. 2A-2C—Perspective Views

FIG. 2A is a perspective view of the unloader shown in the open position fitted on the upper rear side of side wall of magazine 40. A top .22LR round 44 is shown held in place by and between lips 42 of the magazine. The rear side of the magazine has a projecting catch pin 18P (FIG. 2C) that fits into aligner hole 18 of the adapter body to align the unloader in place. Once fitted and aligned with the magazine in the open position, plunger 22 of the unloader is designed and arranged to be substantially centered between lips 42. At its open position (FIG. 2A) the tip is spaced from the rear of topmost round 44.

FIG. 2B is a perspective view of the unloader in a closed position on the magazine. In this position plunger 22 is substantially centered between the lips of the magazine. As shown, the length of the front tip of plunger 22 is selected so that, when closed, it pushes the rear or rim-side of the topmost round forward from the lips, thus releasing round 44 from the magazine to drop free.

FIG. 2C is a rear perspective view of the unloader in operating position where one hand of the user holds the unloader with their thumb on the finger rest of adapter body 12 while their fingers hold the magazine. The user's other hand holds grabber 30 of the pusher part.

Operation—FIGS. 1A-2C

The unloader provides substantial assistance to a firearm user by enabling the user to safely, comfortably, and very rapidly unload magazines without finger pain or injury.

Principally, unloading rounds from a magazine is accomplished by repeatedly operating the unloader (moving its pusher from it open position to its closed position) to sequentially push forward the top round of the magazine far enough to clear it from the holding lips.

To install the unloader (comprising the hinged adapter and pusher plates) on the magazine, side walls 14 of the adapter are slid over the lateral sides of the magazine as shown in FIG. 2A. Hole 18 of the adapter is fitted over projecting catch pin 18P on the back side of the magazine; the hole is positioned so that the adapter will be aligned correctly on the magazine when the pin is inserted in the hole. The pusher is initially in its open position as shown in FIG. 2A so that plunger 22 does not engage the top round in the magazine. When the pusher is pushed to its closed position (FIG. 2B) the pusher and adapter plates are parallel and plunger 22 has pushed a top round in the magazine out of the magazine's feed lips.

The rounds in a loaded magazine can be quickly unloaded by fitting and holding the unloader onto the back side of the magazine with one hand, preferably pressing adapter body 12 with the thumb, and holding the other side of the magazine with the fingers as illustrated in FIG. 2C. The other hand holds grabber 30. Then the user's other hand flips grabber 30 back and forth quickly to move pusher 20 between open and closed positions. When the user moves pusher 20 to the closed position (FIG. 2B), the tip of plunger 22 pushes the top round forward, expelling the top round from the magazine. After the top round is expelled, the user moves the pusher back to the open position. This withdraws the plunger from the space previously occupied by the top round, allowing magazine's inner spring and follower (not shown) to force the second round (not shown) up to the space vacated by the top round so that the second round becomes the top round. By moving the pusher plate back and forth, a user can use the unloader to unload a fully loaded 25-round Ruger BX-25 magazine within 5 seconds. The unloader extends only partially around the magazine as shown in FIGS. 2, 3, and 4 and does not encircle or surround the magazine.

By altering the design and dimensions of the unloader's parts under the principles and methods described, a range of unloaders can be constructed to unload a variety of magazines and round calibers.

Figure 3A:
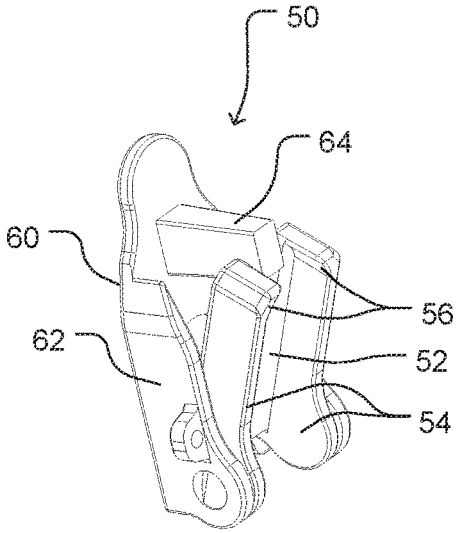
FIG. 3A is a perspective view of a first alternative unloader.
Figure 3B:
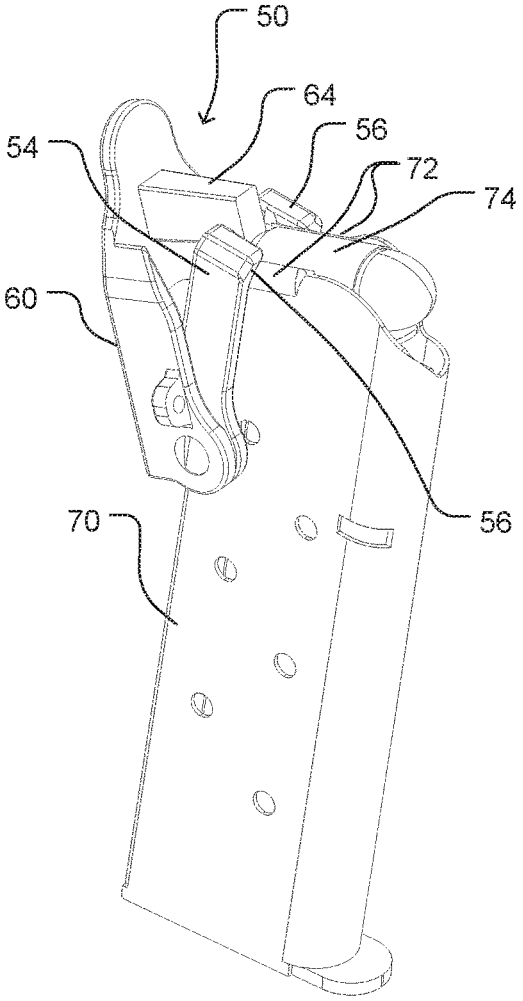
FIG. 3B is a perspective view of the first alternative unloader on a pistol-type magazine.

First Alternative Unloader—Description and Operation—FIGS. 3A-3B—Perspective Views FIGS. 3A-3B are perspective views of a first alternative unloader 50 adapted to load a 1911-type single-stack pistol magazine 70. The unloader includes substantially the same parts and construction as described above. An adapter body 52 has adapter side walls 54, each of which includes an inwardly inclined upper portion 56 that narrows the gap between the sidewalls. A pusher 60 includes a back plate and sidewalls 62 which are hinged at their bottom to adapter 52 as described so that the pusher can shuttle between open and closed positions. The maximum open angle is determined, among others, by the length of the magazine's lips 72. A plunger 64 has a tapering shape with substantially rectangular cross-section and projects forward from the pusher between the lips of the magazine; the plunger is sized and configured to push a top round 74 from the magazine.

In this embodiment, unloader 50 is positioned at the top rear wall of magazine 70 with the inwardly inclined sidewalls portions 56 positioned resting on the rear top of the magazine's lips 72 (FIG. 3B), thus aligning plunger 64 with respect to the lips. As described, the user flips the pusher between open and closed positions, so that in the closed position the plunger expels the top round from the magazine quickly and in the open position the magazine's spring and follower can push the second round to the top position.

As shown, the same basic construction and method of operation of unloader 50 remain as explained further above. Those skilled in the art can easily design and construct alternative unloaders to fit other magazine types.

Figure 3C:
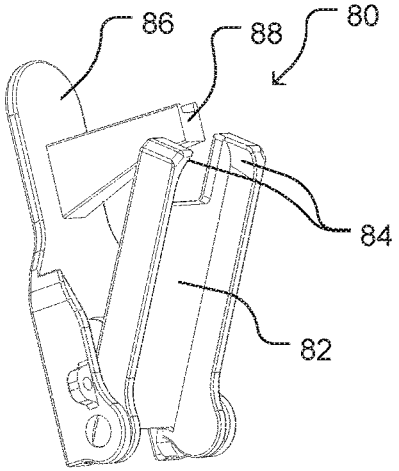
FIG. 3C is a perspective view of a second alternative unloader.
Figure 3D:
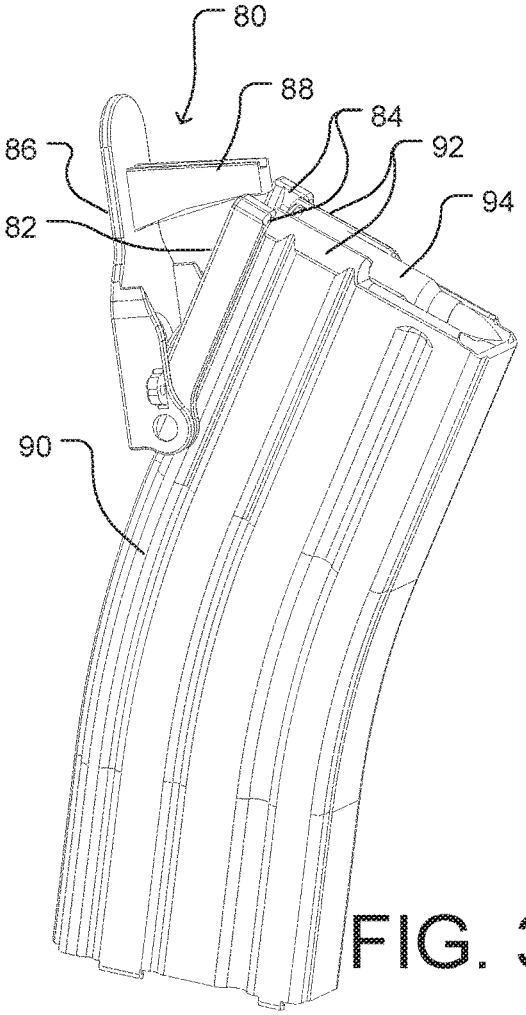
FIG. 3D is a perspective view of the second alternative unloader on a rifle-type magazine.

Second Alternative Unloader—Description and Operation—FIGS. 3C-3D—Perspective Views FIGS. 3C-3D are perspective views of a second alternative unloader 80 adapted to unload 5.56×45 mm double-stack AR15-type magazines 90. Adapter 82 has inwardly-inclined side-walls $\mathbf{8}_4$. A pusher 86 has a back plate and a front projecting plunger 88. The back plate is hinged to adapter 82. Plunger 88 is somewhat wider than the two previous versions to push the alternating rounds on either side of this double-stack magazine. Here again, inwardly-inclined sidewalls 84 are positioned at the rear top of lips 92 for aligning the plunger with respect to the lips of the magazine as shown in FIG. 3D for pushing the top round 94 forward. Once again, the same basic construction and method of operation of the unloader remain as explained above. Those skilled in the art can easily modify the design and construct alternative unloaders to fit other magazine types.

Figure 4A:
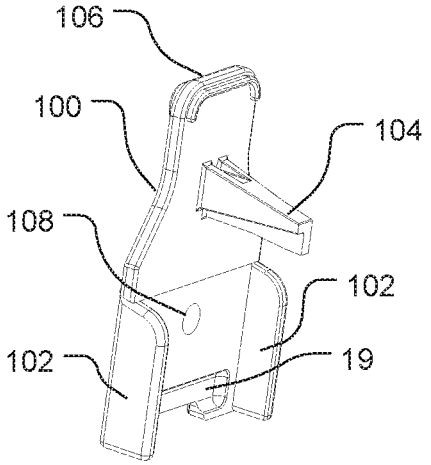
FIG. 4A is a perspective view of a third alternative unloader.
Figure 4B:
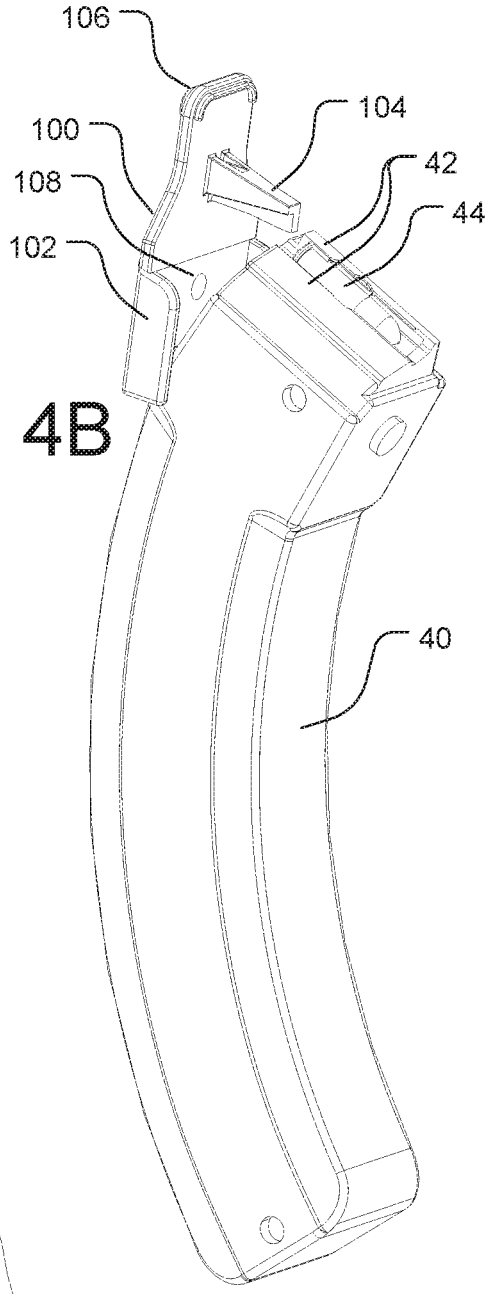
FIG. 4B is a perspective view of the third alternative unloader on a 10/22-type magazine.
Figure 4C:
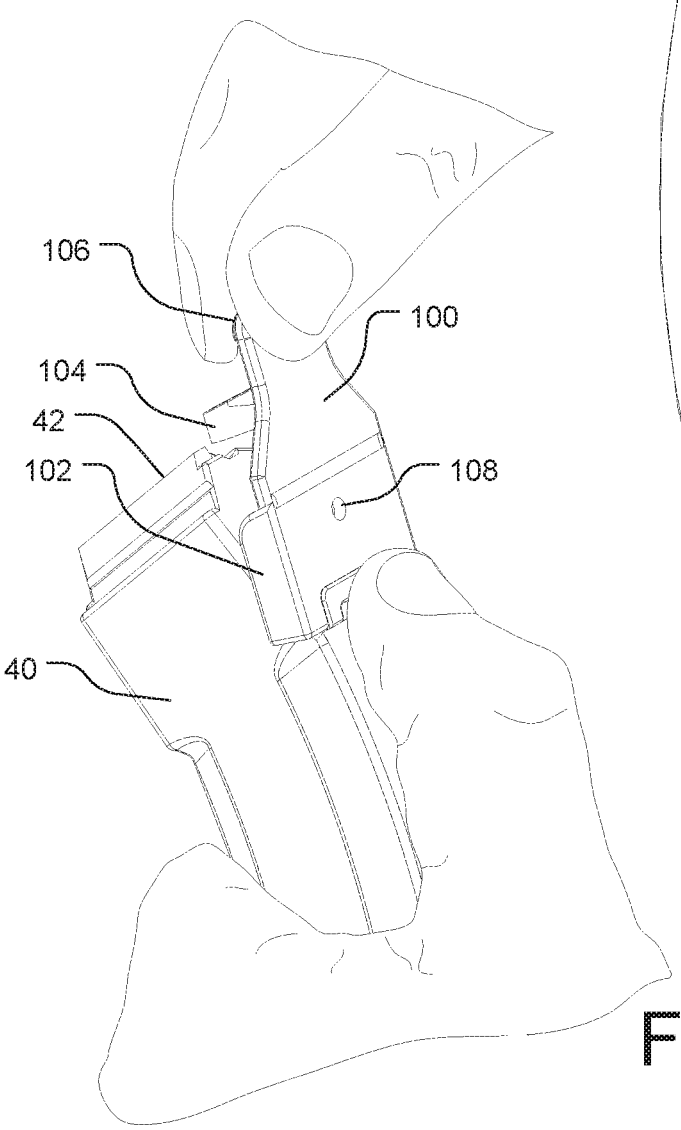
FIG. 4C is a rear perspective view of the third alternative unloader in operating position.

Third Alternative Unloader—Description and Operation—FIGS. 4A-4C—Perspective Views FIG. 4A is a perspective view of a third alternative unloader comprising a single part. It is adapted to unload the same Ruger .22LR cal. magazine 40 of the first embodiment. The unloader comprises a pusher having a substantially flat back plate 100 and a plunger 104 projecting forward from the inner-upper side of plate 100. It further has two sidewalls 102 spaced and sized to loosely accept magazine 40 between sidewalls 102 to stabilize and center the unloader on the magazine while in operation. Both the unloader, its plunger, its grabber 106, and aligner hole 108 are constructed and dimensioned similar to pusher 20 and plunger 22 described earlier, except that the adapter and the pin-and-hole hinging is omitted. FIG. 4B shows the unloader positioned on the magazine where the plunger is clear and rear of top round 44 held by lips 42.

Note that, as with the other embodiments, back plate 100 has a body portion having a bottom end (including magazine recess 19), a top end, and a pair of opposite side edges extending between the bottom and top ends. The bottom end is pivotable with respect to the back wall of magazine 40 so that the body portion of the plate can be tilted or pivoted with respect to the back wall, against or away from the back wall. Its top end 106 can be manually grasped by a user. The plate has a pair of side walls 102 which extend perpendicularly from the opposite side edges of the body portion. The side walls are spaced to sandwich and extend only partially over the lateral sides of the magazine, so that when the plate is pivoted away from the back wall (FIG. 4B), or pivoted closer to the back wall (FIG. 2C), or against the back wall, side walls 102 of said plate will cover only a part of each side wall and the front wall of the magazine will always be uncovered. As with the other embodiments, plunger 104 rigidly and non-pivotably projects from a top portion of the plate, and is shaped and dimensioned so that when the top end of the body portion is tilted away from the back wall (FIG. 1B), the plunger will be clear of any round in the rounds-feeding end of the magazine. When the body portion of the plate is tilted against the back wall (FIG. 2B), the plunger will push any round in said rounds-feeding end out of the magazine.

FIG. 4C shows how the unloader is held on the magazine. Here the user places and fixes a thumb or finger of one hand, e.g., the left hand for illustrative purposes, at the bottom edge or end of the unloader to hold it against the rear wall of the magazine. The bottom edge of the unloader serves as a pivot for the unloader. The fingers of the user's left-hand hold magazine 40 as shown.

Using the right or other hand, the user initially tilts the top of unloader away to the open position from the magazine as shown in FIG. 4B so that its plunger 104 is clear of the topmost round 44 but with aligning hole 108 aligned with but clear of the magazine's catch pin (not shown). The user's thumb holds the unloader to the magazine to allow the unloader to be tilted away from the magazine's back side (FIG. 4C).

The user's right hand now tilts the unloader back and forth. If the thumb or finger of the user's left hand holds the loader in the correct position, its hole 108 will receive the magazine's catch pin 18P and plunger 104 will contact the rear of the rounds and expel them. When the unloader is pivoted against the magazine, if the loader isn't in the correct position, hole 108 will not receive the pin and the plunger will not contact the top round or expel it. In this case the user will be able to adjust their thumb or finger—and hence the unloader's position—easily so that hole 108 will receive the pin and the plunger will contact and expel rounds after one or two tries. The loader is effectively hinged or made pivotable on the magazine through the use of its bottom edge as a pivot and thumb or finger force to hold the loader in place. Sidewalls 102 stabilize and center the unloader's horizontal position during operation.

This unloader is less stable and requires more concentration and skill to operate than the previous two-part versions, yet can unload rounds equally well. Again, those skilled in the art can easily modify the design and construct alternative unloaders to fit other magazine types.

CONCLUSION, RAMIFICATIONS, AND SCOPE

The reader will see that we have provided an efficient, simple, low-cost, palm-size, comfortable and safe magazine unloader comprising few parts. The unloader and variants thereof can unload a wide range of magazines by pushing the top round forward with a plunger extending from a mechanically hinged pusher or thumb- (or finger-) hinged pusher. The unloader allows painless, comfortable, and very quick unloading of rounds.

While the above description contains many specificities, these should not be construed as limitation on the scope but rather as an exemplification of several embodiments thereof.

All numerical values provided are approximate; they can be varied to adapt to other magazines or round types and or sizes. The following are further examples of some but not all variations and ramifications:

The unloader can be adapted to fit and operate with most pistol and rifle magazines and calibers available in the market by providing suitable changes in construction and dimensions under the principles described above. While magazines with followers that are pushed upward by springs have been discussed, the unloader can as well be used to unload magazines with followers that are pushed up by spring-driven rotatable drums.

The unloader and its components may be made of various polymer or other plastic materials, or, alternatively, of other materials, as aluminum, steel or wood, or any combination thereof.

Various other hinging mechanisms and methods may replace the hinging mentioned above. For example, hinging between the adapter body and pusher can be done with a male-female interlocking hinge, a male-female hinge with a coupling pin, and hinging using flexible parts such as rubber or silicon. Hinging can be on the opposite (rear) side of the unloader/plunger.

Various other stopper mechanisms and methods may replace the stopper mentioned above. For example, a semi-circular hinge projection and matching hinge hole designed to limit relative movement can be easily designed and constructed.

The maximum open angle between the adapter body and the pusher may be altered to adapt to other magazines and rounds.

The unloader may also be constructed to include or accept insertable spacer(s) positioned at the inner part of the adapter body opening to accommodate magazines of different widths and/or overall rear-side construction and dimensions.

The unloader's plunger may also be constructed to include or accept insertable spacer(s) or adjusters to change its length or construction to accommodate magazines of different depths and lip construction and/or adapt to rounds of different calibers and lengths.

The adapter body of the unloader may be altered to be removably fixable or lockable to the upper top side of the magazine so the user will not have to hold the adapter body in place when unloading—workable under the method and descriptions here described.

A lock mechanism may be included in the unloader to lock and keep the adapter body and pusher closed so to minimize the size of the unloader for transport and storage.

The unloader plunger may be made foldable, hinged, or removable so to reduce size further.

Accordingly, the scope of our loader should be determined not by the embodiments illustrated, but by the appended claims and their legal equivalents.

We claim:

1. In an unloader for unloading rounds from a firearm magazine having a housing with a rounds-feeding opening and an internal spring pushing for urging said rounds in said magazine toward said rounds-feeding opening, the improvement comprising:

a pusher plate comprising a body portion with a plunger projecting therefrom, said body portion of said pusher plate having a bottom end and a top end and a pair of opposite side edges extending between said bottom and top ends, said bottom end being pivotable on a back wall of said magazine so that said body portion of said plate can be tilted or pivoted with respect to said back wall, against or away from said back wall, said top end being manually graspable by a user, said body portion of said pusher plate having a pair of side walls which extend out perpendicularly from said opposite side edges of said body portion of said plate, said side walls being spaced to sandwich and extend only partially over said housing of said magazine, such that when said body portion of said plate is pivoted against said housing of said magazine, said side walls of said plate will cover only a part said housing of said magazine, so that said side walls extend over only around part of said magazine and do not surround or encircle said magazine, said plunger being rigidly and non-pivotably attached to and projecting from a top portion of said body portion of said pusher plate adjacent said top end, said plunger being shaped and dimensioned so that when said top end of said body portion of said plate is tilted away from said housing of said magazine on the pivot of said bottom end of said body portion of said pusher plate, said plunger will be clear of any round in said rounds-feeding opening of said magazine, and when said body portion of said plate is tilted against said housing of said magazine on the pivot of said bottom end of body portion of said plate, said plunger will push any round in said rounds-feeding opening of said magazine out of said rounds-feeding opening of said magazine, said unloader being free of any springs and extending around only part of said housing of said magazine so that said unloader does not surround said magazine.

2. The unloader of claim 1 wherein said pair of side walls extend from a bottom part of said body portion of said pusher plate, said side walls having a predetermined spacing greater than said housing of said magazine between said side walls so as to center said pusher plate on said magazine.

3. The unloader of claim 1 wherein said magazine has a catch pin projecting from said back side thereof and said pusher plate has a hole therein for receiving said catch pin when said pusher plate is placed against said back wall.

4. The unloader of claim 1, further including an adapter plate that can be positioned on said magazine, said adapter plate and said body portion of said pusher plate each having a bottom end, said bottom ends of said adapter plate and said body portion of said pusher plate having mating hinge parts so that, when said adapter plate is positioned on said magazine and said mating hinge part of said pusher plate is mated with said hinge part of said adapter plate, said pusher plate can be pivoted on said adapter plate so as to be clear of any round in said rounds-feeding opening of said magazine when said pusher plate is tilted away from said adapter plate and said magazine, and said plunger plate will push any round in said rounds-feeding opening of said magazine out of said rounds-feeding opening of said magazine when said pusher plate is tilted against said adapter plate and close to magazine.

5. The unloader of claim 4 wherein said adapter plate has a pair of side walls extending from opposite sides of said bottom end thereof, one of said pusher and adapter plates having a pivot hole in each side wall thereof and the other of said plates having a pintle projecting from each side wall thereof, said pintles being positioned to mate with said respective holes so that said pusher plate can pivot with respect to said adapter plate.

6. The unloader of claim 5 wherein said side walls of said adapter plate are dimensioned to fit over two opposing sides of said magazine when said adapter plate is slid onto said magazine.

7. The unloader of claim 4 wherein said pusher plate has a bifurcated bottom part comprising two legs with a space between said two legs such that when said pusher plate and said adapter plate are mated, a finger or thumb of a predetermined size can be placed in said space between said two legs and against said adapter plate to hold said adapter plate against said magazine.

8. The unloader of claim 4 wherein said pusher plate has a bifurcated bottom part comprising two legs with a space between said two legs such that when said pusher plate and said adapter plate are mated, a finger or thumb of a predetermined size can be placed in said space between said two legs and against said adapter plate to hold said adapter plate against said magazine, a top portion of said pusher plate has a top end spaced above said plunger so that said top portion of said pusher plate has a grasping area above said plunger, said adapter plate has a pair of side walls extending therefrom, said side walls having a predetermined spacing so that when said side walls of said adapter plate are slid onto said magazine, said adapter will be centered on said magazine, said magazine has a catch pin projecting from a side thereof, and said adapter plate has a hole therein for receiving said catch pin when said adapter plate is placed against said magazine.

9. The unloader of claim 1 wherein said top portion of said pusher plate has a top end spaced above said plunger so that said top portion of said pusher plate has a grasping area above said plunger.

10. The unloader of claim 1 wherein said top portion of said pusher plate has a top end spaced above said plunger so that said top portion of said pusher plate has a grasping area above said plunger, said adapter plate has a pair of side walls extending therefrom, said side walls having a predetermined spacing so that when said side walls are slid onto said magazine, said adapter plate will be centered on said magazine, said magazine has a catch pin projecting from said housing thereof, and said adapter plate has a hole therein for receiving said catch pin when said pusher plate is placed against said housing.

11. In an unloader for unloading rounds from a firearm magazine having a housing with a rounds-feeding opening and an internal spring and follower for urging said rounds in said magazine toward said rounds-feeding opening, the improvement comprising:

a pusher plate comprising body portion having a bottom end and a plunger projecting from a top portion of said body portion distal from said bottom end, said plunger being rigidly and non-pivotably attached to and projecting from said top portion of said body portion of said pusher plate adjacent said top end, an adapter plate that can be attached to said back wall of said magazine, said adapter plate having a body portion and a pair of side walls which extend perpendicularly from said opposite side edges of said body portion, said side walls being spaced to sandwich and extend only partially over said housing of said magazine, such that when said body portion is pivoted against said housing of said magazine, said side walls will sandwich and extend only partially over said housing of said magazine, such that when said body portion of said adapter plate is attached to said housing of said magazine, said side walls of said adapter plate extend over only part of said magazine and do not surround or encircle said magazine, said pusher plate having a pair of side walls which extend perpendicularly from said opposite side edges of said body portion of said plate, said side walls being spaced to sandwich and extend over said side walls of said pusher plate and only partially over said housing of said magazine, so that said side walls extends over only part of said housing of said magazine and do not surround or encircle said magazine, said adapter plate and said pusher plate each having mating hinge parts on the bottom ends thereof so that, when said adapter plate is attached to said magazine and said mating hinge part of said pusher plate is mated with said hinge part of said adapter plate, said pusher plate can be pivoted on said adapter plate away from said magazine so said plunger will be clear of any round in said rounds-feeding opening of said magazine, and when said pusher plate is tilted adjacent to said magazine, and said plunger will push any round in said rounds-feeding opening of said magazine out of said rounds-feeding opening of said magazine, said unloader being free of any springs and said unloader extending around only part of said housing of said magazine so that said unloader does not surround said magazine.

12. The unloader of claim 11 wherein said magazine has a catch pin projecting from a side thereof and said adapter plate has a hole therein for receiving said catch pin when said adapter plate is placed against said back wall.

13. The unloader of claim 11 wherein one of said pusher plate and said adapter plate having a pivot hole in each side wall thereof and the other of said plates having a pintle projecting from each side wall thereon therefrom, said pintles being positioned to mate with said respective holes so that said pusher plate can pivot with respect to said adapter plate.

14. The unloader of claim 11 wherein said bottom portion of said pusher plate has a bifurcated bottom part comprising two legs with a space between said two legs such that when said pusher plate and said adapter plate are mated, a finger or thumb of a predetermined size can be placed in said space between said two legs and against said adapter plate to hold said adapter plate against said magazine.

15. The unloader of claim 11 wherein said body portion of said pusher plate has a bifurcated bottom part comprising two legs with a space between said two legs such that when said pusher plate and said adapter plate are mated, a finger or thumb of a predetermined size can be placed in said space between said two legs and against said adapter plate to hold said adapter plate against a magazine, a top portion of said pusher plate has a top end spaced above said plunger so that said top portion of said pusher plate has a grasping area above said plunger, and wherein said magazine housing has a catch pin projecting from said back side thereof, and said adapter plate has a hole therein for receiving said catch pin when said adapter plate is placed against said magazine housing.

16. The unloader of claim 11 wherein said top portion of said pusher plate has a top end spaced above said plunger so that said top portion of said pusher plate has a grasping area above said plunger.

17. In an unloader for unloading rounds from a firearm magazine comprising a housing having two opposite ends, a rounds-feeding end and a bottom opposite end, two pairs of oppositely facing sides connecting said ends, including back and front sides and two lateral sides connecting said back and front sides, a catch pin projecting from said back side, and an internal spring pushing a follower inside said magazine for urging said rounds toward said rounds-feeding end of said magazine, the improvement comprising:

a pusher comprising a plate having a bottom end and a plunger projecting from a top portion of said plate, said plunger being rigidly and non-pivotably attached to and projecting from said top portion of said pusher plate adjacent said top end, an adapter plate that can be attached to said back side of said magazine, said adapter plate and said pusher plate each having mating hinge parts on the bottom ends thereof so that, when said adapter plate is attached to said back side of said magazine and said hinge part of said pusher plate is mated with said hinge part of said adapter plate, said pusher plate can be pivoted on said adapter plate with respect to said adapter plate and said back side of said magazine so that said plunger will be clear of any round in said rounds-feeding end of said magazine when said pusher plate is tilted away from said back wall of said magazine, and said plunger will push any round in said rounds-feeding end of said magazine out of said rounds-feeding end of said magazine when said pusher plate is tilted against said back wall of said magazine, said pusher plate having (a) a bifurcated bottom part comprising two legs with a space between said two legs such that when said pusher plate and said adapter plate are mated, a finger or thumb of a predetermined size can be placed in said space between said two legs and against said adapter plate to hold said adapter plate against a magazine, and (b) a top portion having a top end spaced above said plunger so that said top portion of said pusher plate has a grasping area above said plunger, said adapter plate having a pair of side walls extending therefrom, said side walls having a predetermined spacing substantially equal to the spacing between said lateral sides of said magazine so that when said side walls are slid onto said magazine, said adapter will be centered on said magazine, said side walls of said adapter plate being sized to cover only a part said housing of said magazine, so that said side walls extend over only around part of said magazine and do not surround or encircle said magazine, said adapter plate also having a hole therein for receiving said catch pin of said magazine when said pusher plate is placed against said back side of said magazine, said pusher plate also having a pair of side walls extending from opposite sides thereof, one of said pusher and adapter plates having a pivot hole in each side wall thereof and the other of said plates having a pintle projecting from each side wall thereon therefrom, said pintles being positioned to mate with said respective holes so that said pusher plate can pivot with respect to said adapter plate, side walls of said pusher plate being sized to extend over said side walls of said adapter plate and only part of said side walls of said housing of said magazine, so that said pusher plate extends over only around part of said housing of said magazine and does not surround or encircle said magazine, said unloader being free of any springs and said unloader extending around only part of said housing of said magazine so that said unloader does not surround said magazine.

* * * * *